US005277035A

United States Patent [19]

Fristoe et al.

[11] Patent Number: 5,277,035

[45] Date of Patent: Jan. 11, 1994

[54] MULTI-COMPARTMENT REFRIGERATOR WITH SYSTEM FOR MINIMIZING CONDENSATION

[75] Inventors: John E. Fristoe, Xenia; David B. Kueterman, Anna, both of Ohio

[73] Assignee: Aluminum Company of America, Pittsburgh, Pa.

[21] Appl. No.: 40,921

[22] Filed: Mar. 31, 1993

[51] Int. Cl.[5] ..... F25B 47/00; F25B 27/00

[52] U.S. Cl. ..... 62/277; 62/476; 62/453

[58] Field of Search ..... 62/476, 272, 275, 277, 62/283, 441, 451, 452, 453

[56] References Cited

U.S. PATENT DOCUMENTS

| | | | |
|---|---|---|---|
| 1,992,011 | 2/1935 | Knight | 62/275 |
| 2,651,187 | 9/1953 | Harris et al. | 62/277 |
| 4,147,039 | 4/1979 | Blomberg | 62/277 |
| 4,735,062 | 4/1988 | Woolley et al. | 62/277 |
| 4,914,919 | 4/1990 | Walfridson et al. | 62/236 |

*Primary Examiner*—Henry A. Bennet
*Assistant Examiner*—William C. Doerrler
*Attorney, Agent, or Firm*—David W. Brownlee

[57] ABSTRACT

A refrigerator having multi-compartments and having a heat pipe which transfers heat from a heat source in the refrigeration system to surfaces on the refrigerator which are prone to sweating such as the mullion between compartments. The refrigerator has a gas absorption refrigeration system and the heat pipe is routed from the generator in the system, between the inner and outer shells of the cabinet to the mullion. The heat pipe minimizes condensation of moisture on the external surface of the mullion.

12 Claims, 3 Drawing Sheets

MULTI-COMPARTMENT REFRIGERATOR WITH SYSTEM FOR MINIMIZING CONDENSATION

FIELD OF THE INVENTION

This invention relates to a multi-compartment refrigerator divided into a freezer and a fresh food compartment and more particularly to a heat pipe system for minimizing condensation on exposed surfaces between the two compartments.

BACKGROUND OF THE INVENTION

Condensation on surfaces between compartments in multi-compartment refrigerators has been a problem for many years. The problem has been particularly acute on the external mullion between the freezer compartment and the fresh food compartment, each of which has an external door. Condensation is also a problem in refrigerators where the access to the freezer is inside the food compartment, but is not as severe as with two external doors.

The low temperature requirements in the freezer results in a tendency for the external surface adjacent the freezer to sweat. The surface just below the freezer door and above the fresh food door is the major area for sweating since it is influenced by the cold temperatures of both the freezer compartment and the fresh food compartment. This surface just below the freezer door and above the fresh food door is referred to as the mullion.

The problem has existed in vapor compression electrically powered refrigerators and also gas absorption type refrigerators which may be either electrically or gas energized. The problem is essentially the same regardless of the refrigeration system.

Sweating involves a psychrometric principle. When the temperature drops below the dew point of ambient air, water vapor condenses on colder surfaces. The "ambient air temperature" refers to the temperature of the air surrounding the surface and can more correctly be referred to as the dry bulb temperature. The amount of temperature drop required to cause sweating depends on the humidity ratio of the ambient air. The higher the humidity, the greater the potential for sweating because the surface temperature does not have to drop as far to condense moisture out of the air.

Many things have been proposed and/or tried to minimize the condensation problem. Some of the most common solutions include adding insulation between the inner and outer shells of the refrigerator cabinet, adding fins on the mullion to increase external surface area, heat tape, electric heaters, reducing the cooling performance for the freezer compartment, adding a loop of condenser tubing behind the mullion, and providing circulation of heated air across the problem surface.

U.S. Pat. No. 1,992,011 to Knight discloses a refrigerator cabinet which includes two hermetically sided tubes which are filled with liquid refrigerant or other volatile liquid and which are arranged along the length of the mullion and cabinet walls to transfer heat to the mullion to maintain its temperature above the dew point of the surrounding air. This system uses the heat from the outside surface of the refrigerator which is substantially at the temperature of the surrounding air.

Some examples of prior art attempts to control condensation by disposing a loop of the refrigeration condenser liquid line around the cabinet door openings include U.S. Pat. Nos. 2,135,091; 3,572,051; 3,984,223 and 4,192,149. Adding such a condenser loop causes difficult fabrication problems, especially for gas adsorption type systems which require welded steel tubing that must be properly sloped to insure gravity drainage. A condenser loop in the mullion creates an unwiedly construction and is almost impossible to replace in the field.

Electric heaters to minimize condensation are disclosed in U.S. Pat. Nos. 3,859,502 and 3,939,666. The use of electric heaters or heat tape is not available for some refrigerators such as refrigerators which are powered by propane or natural gas when electricity may not be available as in some recreational vehicles and remotely located homes.

A system for minimizing condensation is needed that is inexpensive, maintenance free, and which does not require electrical energy.

SUMMARY OF THE INVENTION

This invention involves using a heat pipe to transfer heat from a heat source at the rear of the refrigerator to the surface where sweating normally occurs. The invention is particularly advantageous for a refrigerator capable of operating where no external electrical power source is available since the invention requires no electrical input. A gas powered (propane or other gases) absorption refrigerator is an example of an application where the installation does not require electricity to operate and may not have electricity available. The absorption refrigerator produces heat at its generator and some of the waste heat from the process can be used to drive the heat pipe.

A heat pipe is existing technology which uses a self-contained length of tube with no mechanical moving parts. Heat pipes are filled with suitable working fluids, evacuated, and permanently sealed on both ends. The heat pipe transfers heat by absorbing heat at one end (evaporator) and releasing heat at the other end (condenser). The working fluid in the heat pipe is selected to have a suitable vapor pressure at the desired operating temperature. The heat pipe may include a wick of appropriate design to promote the return of condensed fluid from the condenser end back to the evaporator end of the pipe. Application of heat at the evaporator end vaporizes the fluid in the pipe, with the vapor pressure driving the vapor to the condenser end of the pipe. The colder condenser end causes the vapor to condense and release heat. The condensate returns to the evaporator end by gravity and/or the wicking process. The process is essentially continuous as long as there is an appropriate difference in temperature at the ends of the pipe.

An object of this invention is to provide a refrigerator having minimal condensation problems on surfaces adjacent a cooling compartment or compartments in the refrigerator.

A further object is to provide a refrigerator having a heat pipe for transferring heat from a heat source in the refrigeration unit to the mullion between the freezer compartment and fresh food compartment in the refrigerator.

Another object is to provide apparatus for minimizing condensation on a gas absorption type refrigerator which is capable of operating where no external electrical power source is available as with refrigerators for recreational vehicles and homes situated at remote locations.

The above and other objects and advantages of the invention will be apparent from the following description and drawings and which is characterized in the claims annexed hereto.

DESCRIPTION OF PREFERRED EMBODIMENT

Figure 5:
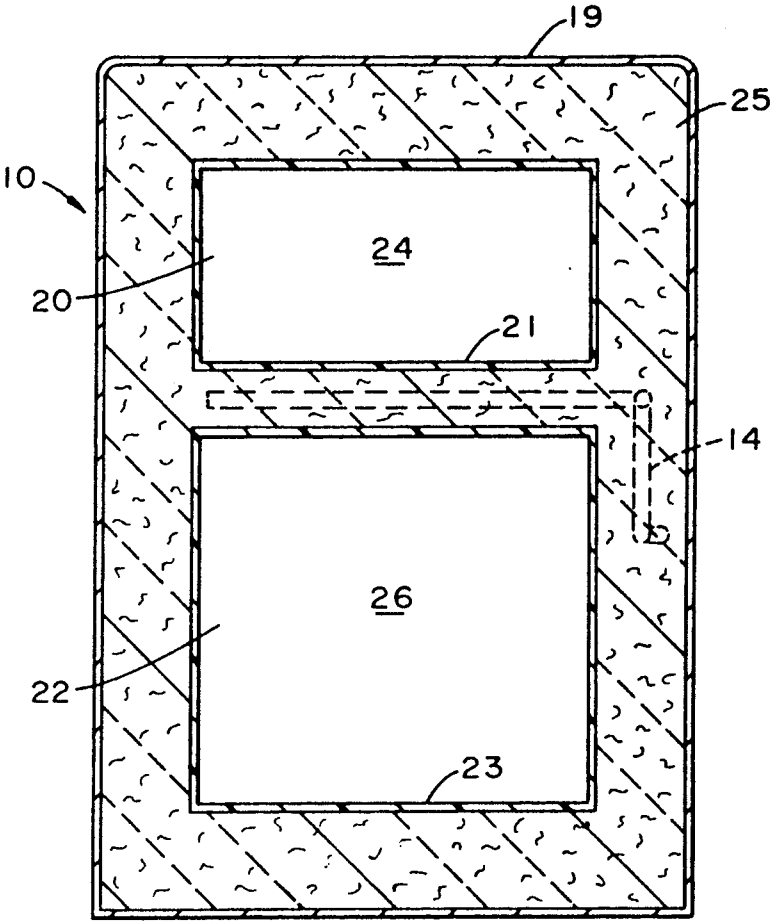
FIGS. 4 and 5 are vertical cross sectional views through a refrigerator of this invention showing the disposition of the heat pipe in the insulated walls of the refrigerator.
Figure 4:
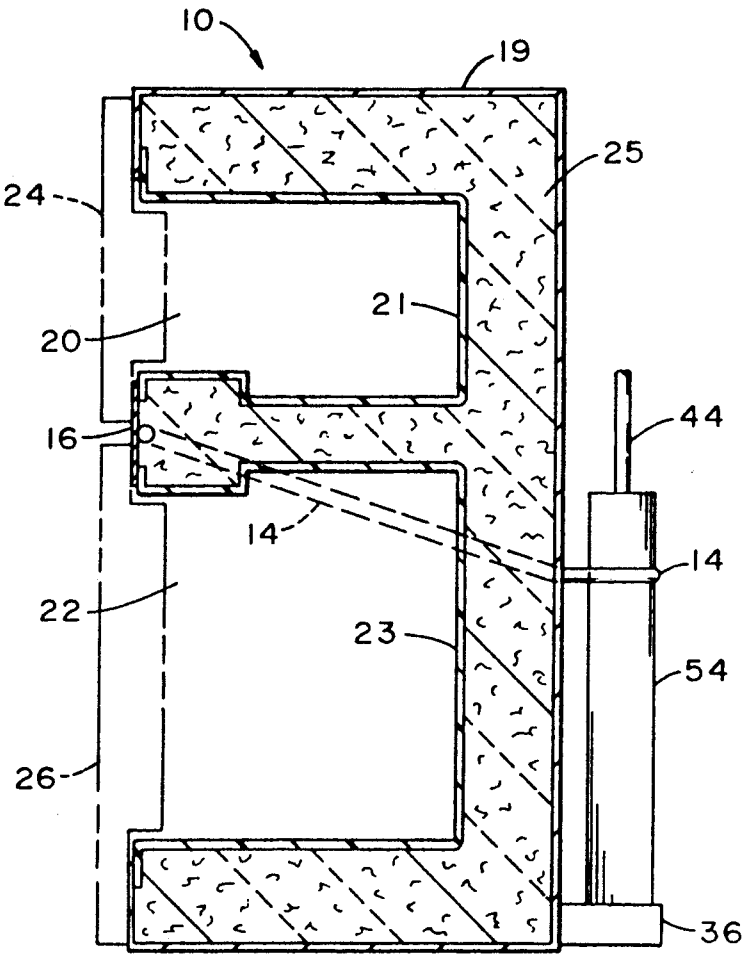

Referring to the drawings, a typical two door refrigerator 10 is shown having a gas absorption refrigeration system 12 and which includes a heat pipe 14 for transferring heat from the heat source in the refrigeration system to the mullion 16 between the two compartments in the refrigerator. The refrigerator 10 has a cabinet 18 with a freezer compartment 20 and a fresh food compartment 22, each of which has an opening through the cabinet and doors 24 and 26 for the openings. The mullion 16 is the divider between the two compartments in the cabinet. The mullion 16 in most refrigerators is prone to condensation due to the cooling effect of the two compartments. The mullion panel 16 is approximately 1 to 2 inches wide in most refrigerators. As best shown in FIGS. 4 and 5, the cabinet 18 comprises an outer shell 19, inner shells 21 and 23 spaced from the outer shell, and suitable insulating material 25 such as fiber glass mat or polymer foam between the shells. The outer shell 19 is typically made of sheet metal and the inner shells 21 and 23 are typically made of plastic polymer material. The heat pipe 14 enters the back of the refrigerator, and is disposed in one of the side walls of the refrigerator, and behind the mullion 16.

Figure 1:
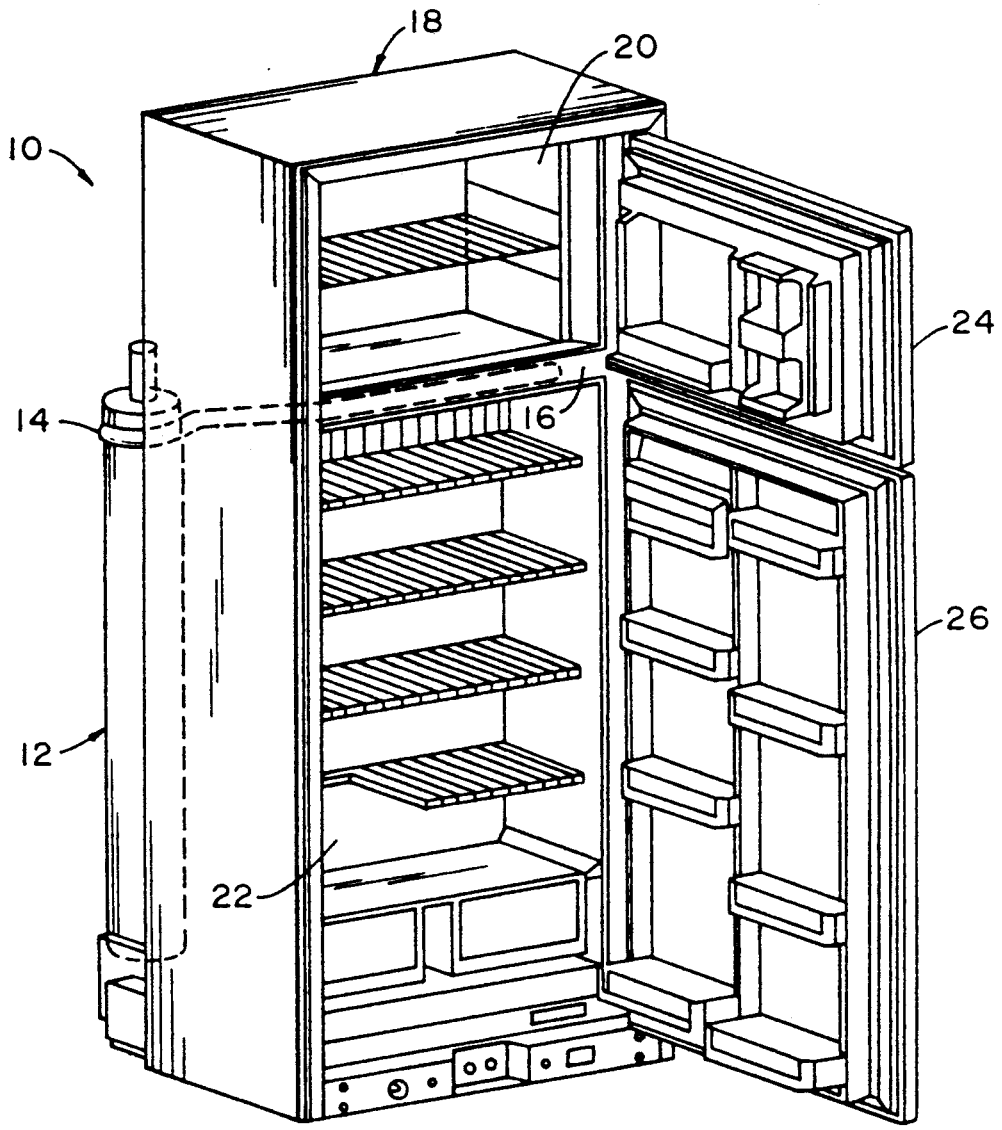
FIG. 1 illustrates a typical multi-compartment gas absorption type refrigerator.
Figure 2:
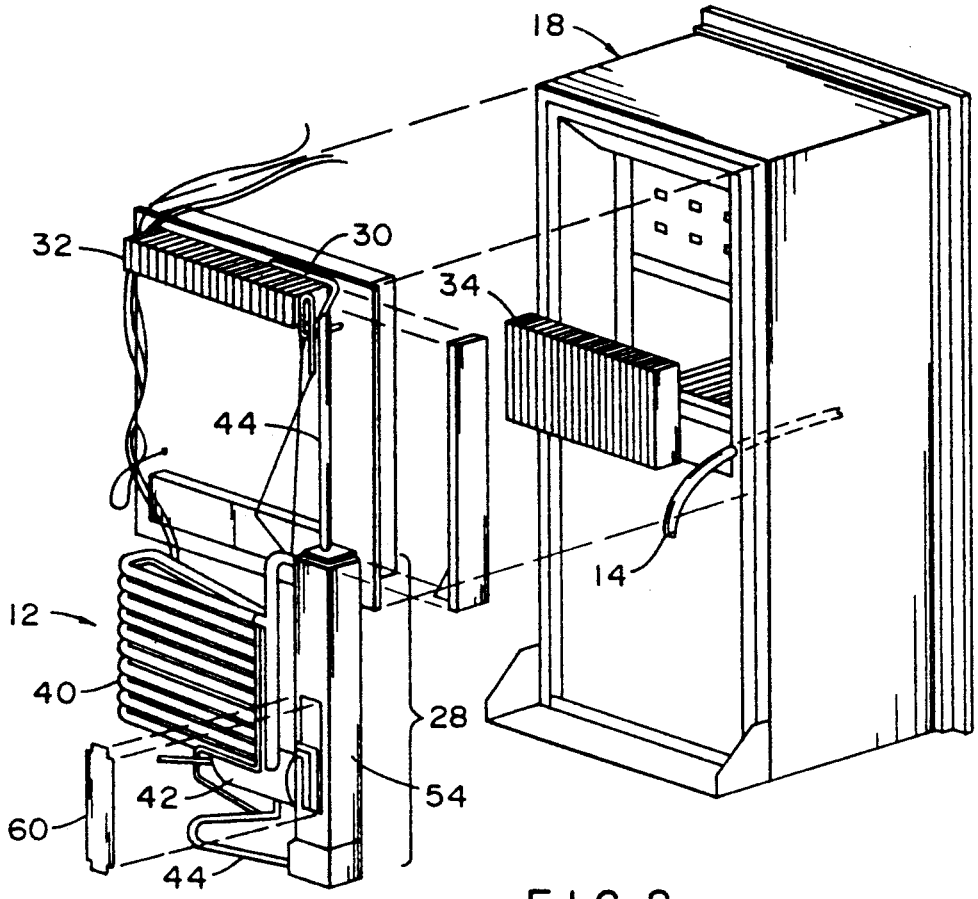
FIG. 2 is an exploded view showing the gas absorption refrigeration system in position to be installed in the refrigerator of FIG. 1.

FIG. 2 shows a typical gas absorption refrigeration system 12 for disposition the rear of the cabinet 18. This system includes a generator 28, a rectifier 30, a condenser 32, an evaporator 34, an absorber 40, a leveling chamber 42, a liquid heat exchanger 44 and the associated liquid lines as well known in the art. The refrigeration system is conventional and forms no part of this invention.

Figure 3:
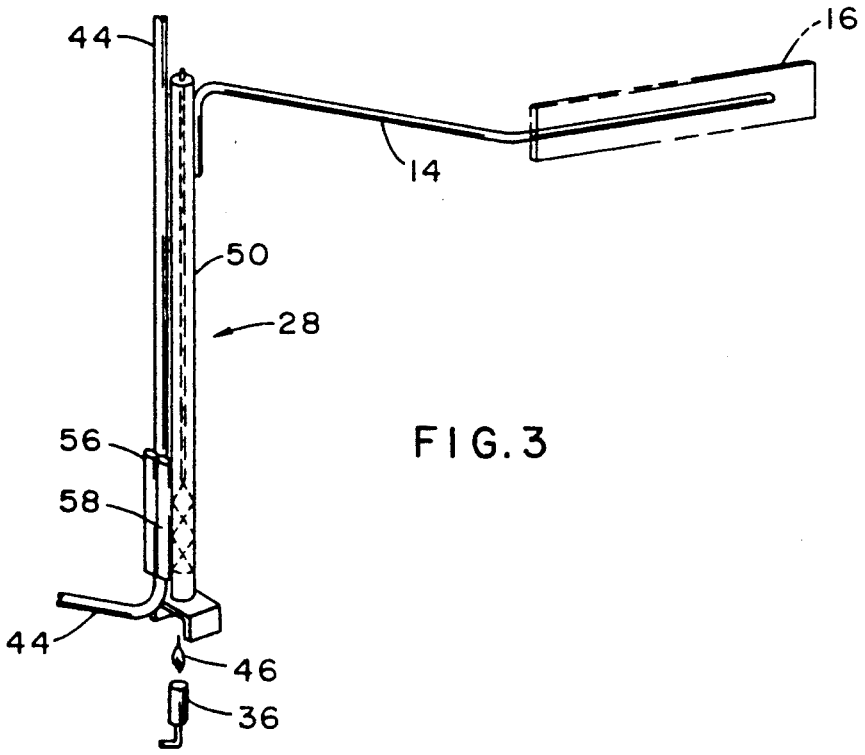
FIG. 3 shows a generator from a gas absorption system and a heat pipe for transferring heat from the generator to the mullion between the compartments in the refrigerator of FIGS. 1 and 2.

FIG. 3 shows the generator 28 in greater detail. The generator 28 preferably includes a gas burner 36, which may be adapted to burn propane or other gas to produce a heating flame 46. A fire tube 50 transfers the heat from the flame to the liquid heat exchanger 44. A metal jacket 54 (FIG. 2) encloses the generator 28 and fire tube 50. The generator 28 also preferably includes a 12 volt heater 56 and a 120 volt heater 58 for use with either a batter or a residential electric power source. A cover plate 60 (FIG. 2) covers an opening into the jacket 54 to provide access to the generator inside.

As further shown in FIG. 3, the heat pipe 14 is secured to the fire tube 50 in the generator 28. The heat pipe 14 could also be affixed to the metal jacket 54 around the generator or to other heat sources in the refrigeration system such as the burner box or absorber coil. The heat pipe is Preferably secured to the heat source by metal strap, not shown, or by spot welding to the metal fire tube or jacket to ensure good heat transfer between the pipe and the heat source.

The heat pipe 14 consists of a tube, usually copper, of approximately ⅜ to ½ inch outside diameter and is long enough to be routed from the heat source at the back of the refrigerator to the problem area such as the divider mullion. Heat pipes are commercially available from several companies including Noren Products Inc. of Menlo Park, Calif.

The heat pipe 14 is concealed from the user by being routed though the insulation space between the inner and outer shells of the cabinet 18 and to the rear side of the divider mullion 16. The heat pipe 14 preferably extends across substantially the full width of the mullion 16. The heat source is selected to produce the correct temperature range at the condenser end. For instance, the evaporator end of the heat pipe 14 can be attached to the upper section of the metal jacket 54 around the fire tube. A jacket temperature of approximately 120° F. will maintain a fluid temperature of approximately 112° F. at the evaporator end of the tube, and a temperature of approximately 100° F. in the mullion. The difference in temperature at the two ends of the pipe and in the mullion is due to conduction losses through the tube wall, and across the connections between the jacket, heat pipe and mullion. A mullion temperature of 100° F. is satisfactory for keeping its exposed surfaces free of condensation as long as ambient temperatures do not exceed 100° F. In a preferred embodiment of this invention, the thermodynamic working fluid has a vapor pressure which will result in condensation of gaseous fluid in the pipe at a temperature in the range of 90°-100° F.

The heat source for the heat pipe is selected so the condenser end of the heat pipe will maintain the problem area at a temperature above the dew point in a worst case situation. Since the heat source is available only when the refrigerator is operating (the gas burner or an electric heater is operating), the heat produced by the condenser must be great enough to provide thermal inertia when the refrigerator is cycled off. However, the need for heat at the mullion is reduced when the refrigerator cycles off since the cooling process which causes the sweating problem is also less.

The advantages of this invention include the absence of any requirement for electrical input, maintenance free operation with no moving parts, energy efficient use of waste heat and avoidance of interdiction into the refrigeration system as with the use of a loop from a condenser coil. Another advantage is that the desired heat is provided to the problem area at the times of greatest need, which is when the refrigerator is running. The heat transferred is maximized when the refrigerator is running and minimized during the "off cycle". The need for heating to minimize sweating is also greatest when the refrigerator is running and least during the "off" cycle.

Although a preferred embodiment has been selected for illustration which includes a two door gas absorption type refrigerator, it will be apparent to those skilled in the art that the invention is also applicable to electrically energized evaporator refrigerators and to refrigerators in which the freezer compartment is contained within the fresh foods compartment. The invention can also be used with side-by-side refrigerator compartments. The heat source for the heat pipe can also be the absorber coil, electric heater, burner box or the like that provides heat above ambient temperatures, especially when the refrigeration unit is cooling the food compartments. The surface to which the heat is transferred to minimize sweating can also vary depending on the particular design of the refrigerator. In addition to the mullion between the doors, the surface could be around the doors or other surfaces which are not easily insulated from the freezer or fresh foods compartment.

What is claimed is:

1. In a refrigerator comprising a cabinet and a gas absorption refrigeration system which includes a heat source with said cabinet having a fresh foods compartment and a freezing compartment, the improvement comprising a closed and sealed heat pipe containing a thermodynamic working fluid, said heat pipe having a first end portion thereof disposed in heat transfer relationship with said heat source in the refrigeration system, a second end portion disposed adjacent at said freezing compartments, and the remainder of the heat pipe concealed in said cabinet and connecting said first and second ends for transferring heat from said first end to said second end to minimize condensation adjacent said freezing compartment.

2. A refrigerator as set forth in claim 1 in which said heat source includes a gas burner.

3. A refrigerator as set forth in claim 1 in which said heat source is an electric heater.

4. A refrigerator as set forth in claim 1 which includes both a gas burner and an electric heater and said first end portion of said heat pipe is disposed in heat transfer relationship with at least one of said gas burner and said electric heater.

5. A refrigerator as set forth in claim 1 in which the fresh foods compartment and the freezing compartment each has an external opening and a door therefor, said cabinet further has a mullion between the external openings for the two compartments, and said heat pipe extends for substantially the full width of said mullion.

6. A refrigerator as set forth in claim 1 in which said thermodynamic working fluid has a vapor pressure so that the fluid will condense in the pipe at a temperature in the range of approximately 90°-100° F.

7. A refrigerator comprising a cabinet having a freezer compartment, a fresh food compartment, and a divider therebetween, a gas absorption refrigeration system which cools the compartments and produces heat, and a heat pipe having an evaporator end which absorbs heat from said refrigeration system and a condenser end which transfers heat to said divider to minimize condensation of moisture on the surface of the divider.

8. A refrigerator as set forth in claim 7 in which said cabinet includes an inner shell and an outer shell spaced from the inner shell and said heat pipe is routed between said shells.

9. A refrigerator as set forth in claim 7 in which said refrigerator system is a gas absorption system having a generator adapted to be fueled by gas.

10. A refrigerator as set forth in claim 9 in which the evaporator end of said heat pipe is secured in heat transfer contact with said generator.

11. A refrigerator with no electrical connections comprising a cabinet having a freezer compartment and a fresh food compartment each of which has an external opening and a door therefor with a horizontal mullion between the two openings, said cabinet further comprising an inner shell and an outer shell spaced from the inner shell with insulating material between the two shells, said refrigerator further including a gas absorption refrigeration system that includes a generator adapted to be fueled by gas and a heat pipe concealed in the space between the inner and outer shells of said cabinet having an evaporator end in heat transfer relationship with said generator and a condenser end in heat transfer relationship with said mullion for minimizing condensation of moisture on the external surface of said mullion.

12. A refrigerator as set forth in claim 11 in which said heat pipe contains a working fluid having a vaporization temperature of approximately 90°-100° F.

* * * * *